US009822962B2

(12) United States Patent
McGilvray

(10) Patent No.: US 9,822,962 B2
(45) Date of Patent: Nov. 21, 2017

(54) UNDERWATER MODULAR LIGHT PROBE

(71) Applicant: Bryan C. McGilvray, Jupiter, FL (US)

(72) Inventor: Bryan C. McGilvray, Jupiter, FL (US)

( * ) Notice: Subject to any disclaimer, the term of this patent is extended or adjusted under 35 U.S.C. 154(b) by 258 days.

(21) Appl. No.: 14/634,652

(22) Filed: Feb. 27, 2015

(65) Prior Publication Data

US 2015/0247632 A1 Sep. 3, 2015

Related U.S. Application Data

(60) Provisional application No. 61/946,670, filed on Feb. 28, 2014.

(51) Int. Cl.

| | |
|---|---|
| ***F21V 31/00*** | (2006.01) |
| ***F21V 5/04*** | (2006.01) |
| ***F21V 29/74*** | (2015.01) |
| ***F21V 23/00*** | (2015.01) |
| ***F21V 13/04*** | (2006.01) |
| *F21Y 115/10* | (2016.01) |

(52) U.S. Cl.

CPC ..... *F21V 31/005* (2013.01); *F21V 5/04* (2013.01); *F21V 13/04* (2013.01); *F21V 23/009* (2013.01); *F21V 29/74* (2015.01); *F21Y 2115/10* (2016.08)

(58) Field of Classification Search

CPC ..... F21V 31/005; F21V 5/04; F21V 29/74; F21L 4/022

USPC ..... 362/101

See application file for complete search history.

(56) References Cited

U.S. PATENT DOCUMENTS

| | | | | |
|---|---|---|---|---|
| 7,854,529 | B2 | 12/2010 | Uke | |
| 8,444,283 | B1 * | 5/2013 | Miller | F21V 15/01 362/101 |
| 2006/0109662 | A1 * | 5/2006 | Reiff | F21L 4/04 362/373 |
| 2012/0120639 | A1 | 5/2012 | Armer et al. | |
| 2012/0140433 | A1 | 6/2012 | Armer et al. | |

* cited by examiner

*Primary Examiner* — Karabi Guharay

(74) *Attorney, Agent, or Firm* — Akerman LLP; Mammen (Roy) P. Zachariah, Jr.; Ryan Harding

(57) ABSTRACT

An underwater light probe includes a body, a heat sink, and a lens assembly. The heat sink forms at least a portion of the body and includes a longitudinally extending mounting base having a plurality of laterally facing mounting surfaces configured to mount a plurality of laterally facing light elements thereon. The lens assembly is configured to couple to the body and defines a bore configured to receive the longitudinally extending mounting base and the plurality of laterally facing light elements mounted thereon and provide a watertight seal therearound when coupled to the body.

20 Claims, 18 Drawing Sheets

UNDERWATER MODULAR LIGHT PROBE

CROSS REFERENCE TO RELATED APPLICATIONS

The present application is related to and claims priority to U.S. Provisional Application Ser. No. 61/946,670, filed Feb. 28, 2014, entitled MODULAR UNDERWATER LED PROBE, the contents of which are hereby incorporated by reference in their entirety.

TECHNOLOGY

This disclosure pertains to underwater lighting devices, specifically to underwater lighting devices utilizing Light Emitting Diodes (LEDs) as well as heat sinks for underwater lighting devices.

BACKGROUND

LEDs have been used for underwater lighting applications. These applications include scuba diver hand held flood and spot lights, through hull boat lighting, underwater vehicle lighting, underwater photography, etc. As with other lighting sources such as incandescent, fluorescent and halogen lighting sources, underwater lighting applications face challenges in marine environments including challenges relating to field of illumination, pressure tolerance, heat dissipation, power design, and control features.

SUMMARY

In one aspect, an underwater light probe comprises a body and a heat sink. The heat sink forms at least a portion of the body and comprises a longitudinally extending mounting base. The mounting base comprises a plurality of laterally facing mounting surfaces configured to mount a plurality of laterally facing light elements thereon. The light probe further comprises a lens assembly configured to couple to the body. The lens assembly may define a bore configured to receive the longitudinally extending mounting base and the plurality of laterally facing light elements mounted thereon and provide a watertight seal therearound when coupled to the body.

In another aspect, a modular underwater light probe comprises a body comprising an interface configured to couple to an implement; a heat sink forming at least a portion of the body and comprising a longitudinally extending mounting base comprising a plurality of laterally facing mounting surfaces configured to mount a plurality of laterally facing light elements thereon; and a lens assembly configured to couple to the body. The lens assembly may define a bore configured to receive the longitudinally extending mounting base and the plurality of laterally facing light elements mounted thereon and provide a watertight seal therearound when coupled to the body.

In yet another aspect, an underwater lighting device system comprises a light probe configured to be selectively coupled to one or more implements. The light probe may include a body, a heat sink, and a lens assembly. The heat sink may form at least a portion of the body and comprise a longitudinally extending mounting base that comprises a plurality of laterally facing mounting surfaces configured to mount a plurality of light elements thereon. The lens assembly may be configured to couple to the body. The lens assembly defines a bore configured to receive the longitudinally extending mounting base and the plurality of light elements mounted thereon and provide a watertight seal therearound when coupled to the body.

BRIEF DESCRIPTION OF THE DRAWINGS

A more complete understanding of the present disclosure and its features and advantages will become apparent with reference made to the following description, taken in conjunction with the accompanying drawings, in which.

DESCRIPTION

Figure 1:
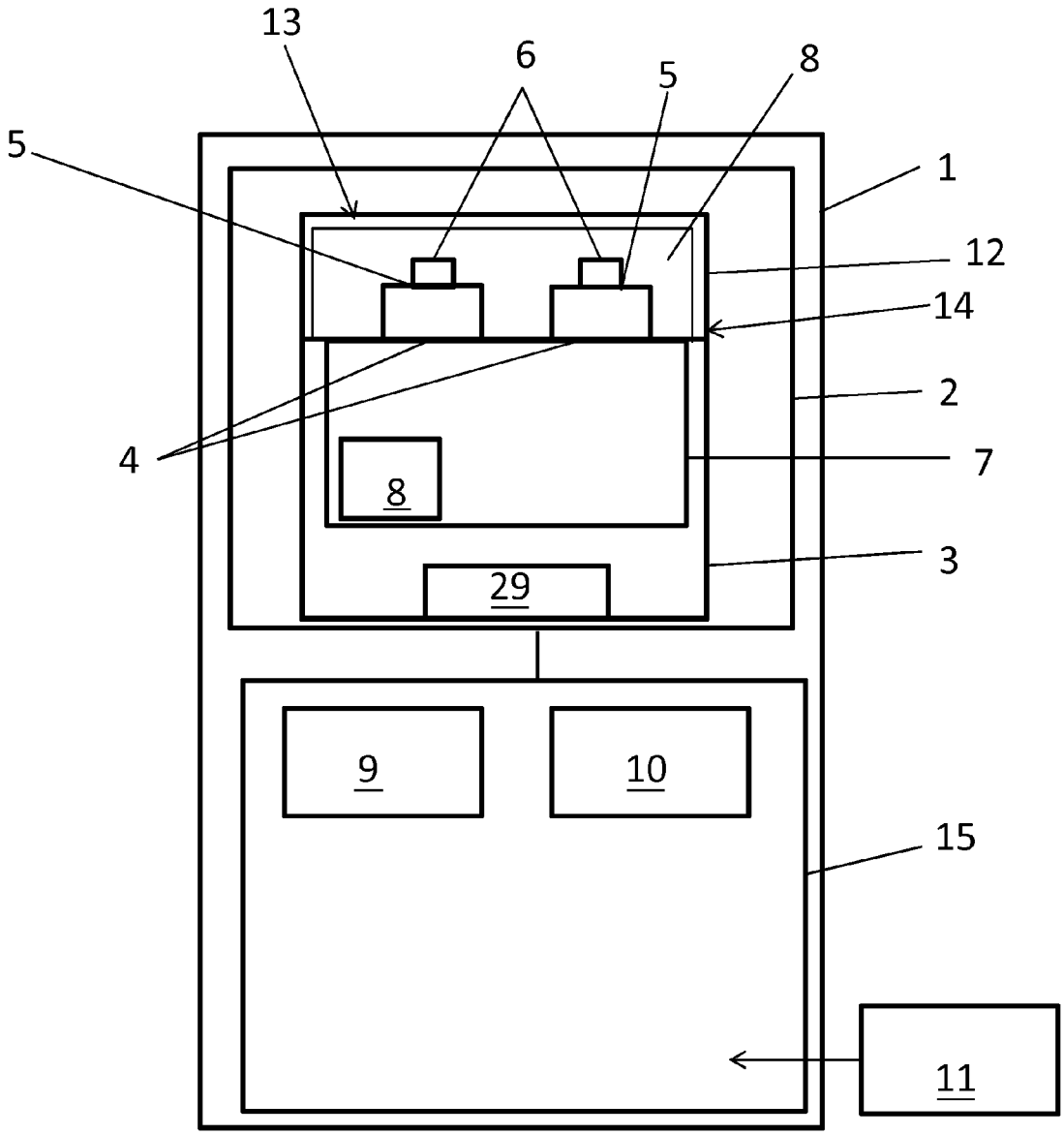
FIG. 1 is a semi-schematic of a lighting device system according to various embodiments described herein.

Design challenges with respect to underwater lighting applications include structural and interface pressure tolerance, heat dissipation, mechanical size constraints due to reflector or lens integration, and power conditioning and control circuitry. When addressing these and other design challenges, consideration should be paid to the intended use of the device with respect to size, weight, beampattern, chromaticity, power rating, controllable features, interfaces, etc.

Current underwater lighting apparatuses are typically designed as a visual aid respective to a specific task. That is, due to variance in underwater lighting applications, underwater lights are typically designed to perform within the confines of a single underwater task or application. For example, a dive spot light may be designed to emit a narrow beam in order to focus the light intensity over a small area. While this may be beneficial to the achievable range and intensity, applications such as photography or videography, which involve a viewing angle that is greater than the projected light field's beam could benefit from a wider projected light field. Additionally, dive lights may project a cool white or other semi-narrowband beam for viewing or searching. However, as with the narrower beam, the chromaticity of the projected light may not be optimal for photography or videography, especially in an underwater environment. Alternately, an underwater light designed for photography or videography may comprise a light array with one or more red light emitting diodes (LEDs) and one or more forms of white LEDs, etc. to achieve an optimal color for the given environment. Current underwater lights are designed specifically for use in an underwater environment, not for use in air. As a consequence, current underwater lights may be damaged when used in air because overheating may occur. While a thermal regulation circuit may be used, this circuit limits the useable light in air.

A lighting device system as disclosed herein may comprise a light probe integrated with or configured to be selectively coupled to an implement. The lighting device system may further include a streamlined form factor and a plurality of pressure tolerant mechanical, thermal, and electrical interfaces to facilitate modular integration of the light probe, light elements, lens, or assemblies thereof. For example, the lighting device system may include a lens assembly selectively coupleable with respect to a body of the light probe to provide a watertight environment around the light elements. The light probe body may also include a light element mounting base and surface configured for mounting one or more light elements or light element assemblies. The body may further include a heat sink to transfer heat from the light elements to the surrounding environment. The heat sink may be formed along the light element mounting base and surface and include heat exchange features configured to aid in the exchange of heat. The heat sink assembly may be waterproof and comprise all or a portion of the body of the light probe and may include a light element assembly mounting surface formed along a mounting base. Further, the body may operatively interface with the implement mechanically or electrically at one or more mechanical and electrical interfaces.

In various embodiments, the lighting device system comprises a compact, high performance modular LED light probe with the capacity to project useful and controllable light on a desired object or into a desired volume, while providing the ability to interact with the underwater environment, or serve multiple uses including operation in air or another fluid. For example, the lighting device system may comprise a modular light probe configured to selectively couple to multiple implements for interacting with a marine environment. The lighting device system may further comprise a selection of modular components configured to be interchangeably coupled to the modular light probe. The modular components may comprise a plurality of light element assemblies having different light element arrangements such that particular light element assemblies may be selectively coupled to the light probe to produce a desired beampattern or projected light field. The modular components may also include a plurality of lens assemblies that may be selectively coupled to the light probe to provide a desired beampattern or projected field. As such, the various embodiments of the lighting device system may include a modular light probe and components configured to provide a robust, compact, versatile, modular illumination device with a form factor and capacity to explore and interact with an underwater environment.

These and other features and benefits thereof will become more apparent upon consideration of the following descriptions and accompanying drawings of the various exemplary embodiments wherein similar features are similarly numbered.

FIG. 1 is a semi-schematic illustration of an embodiment of a lighting device system 1. The lighting device system 1 comprises a light probe 2. The light probe 2 comprises a body 3 providing a base for various components of the light probe 2. For example, the body may define one or more light element mounting bases 4 for mounting one or more light elements 6 directly or indirectly by mounting light elements 6 on light element assemblies 5. The light element assemblies 5 generally include light elements 6 or other light element electronics, as described in more detail below. The body 3 may further include a heat sink 7 configured to receive and conduct heat generated by the light elements 5. The heat sink 7 may include heat exchange features 8 configured to assist in dissipation or exchange of heat to the surrounding environment. Thus, the body 3 may form a base for one or all of the light elements 6 and all or part of the heat sink 7.

The body 3 may also provide a base for coupling electronics assemblies used to modulate the control operations of the light elements 6, e.g., a controller 9, user interface 10, and wiring for conducting a supply of power from a power source 11 or as a pass through for electrical wiring coupling the light elements 6 and electronic assemblies 9, 10, 11. The body 3 may also be configured to provide pressure tolerant mechanical and electrical interfaces. For example, the body 3 may include a watertight mating interface configured to sealingly couple to a lens assembly 12 positioned around the light elements 6. The light elements 6 and mounting base 4 may therefore be received within the bore 18 to be maintained in an airtight volume when the lens assembly 12 is coupled to the body. The body 3 may also include a mechanical and electrical interface 29 configured to operatively couple to a controller 9 configured to interface a user with light control operations of the light probe 2, such as selective cycling, sequencing, power or intensity modulation, beampattern control, etc. of light emission from a plurality of light elements mounted to the light probe. The mechanical and electrical interface 29 may also include mechanical attachment points for coupling the probe 2 to an implement 15.

Light elements 6 are generally described herein with respect to LEDs or LED arrays; however, in various embodiments, light elements 6 may comprise any suitable illuminating devices such as bulbs, tubes, panels, or cells configured for incandescence, luminescence or any other form of light emission. Light elements 6 comprising LEDs may provide durability, luminous efficacy, directivity, and rated runtime over incandescent and other types of luminescence. The light device system 1 is preferably configured to provide controllable light through modulation, e.g., powering, cycling, selection, dimming, etc. of one or more light elements 6. As used herein, a controllable light includes at least one of or all of an ability to be dimmed, the beampattern to be controllable (based on electronically switching LEDs comprising an array with respect to the geometry, integrated lens or reflectors, or composition of the LED array elements), and the chromaticity to be controlled by selectively dimming portions of light elements 6, such as LED arrays.

The light probe 2 may further comprise a lens assembly 12. The lens assembly 12 defines a bore 18 and includes a lens 13 portion through which light emitted by the light elements 6 may pass into the surrounding environment. The lens assembly 12 also includes a fitting 14 configured to attach to the body 3 of the light probe 2 to form a water tight seal around the light element assemblies 5. The lens assembly 12 may be configured to be replaceable such that the lighting device system 1, including the light probe 2, may be used to mechanically interact with the marine environment, e.g., when integrated with or coupled to an implement 15, either directly or indirectly, which may leave the lens assembly 12 susceptible to mechanical impact and abrasion. The lens assembly 12 may therefore be configured for ease of replacement to maintain optical clarity along the lens portion 13 that may otherwise become compromised with repeated exposure to impact or abrasion.

In one embodiment, the lens assembly 12 may be selectively removable for replacement or interchange with additional lens assemblies 12. For example, in one embodiment, the body 3 is configured to receive a plurality of interchangeable lens assemblies 12. Thus, in one embodiment, the lighting device system 1 may include a plurality of interchangeable lens assemblies 12. The interchangeable lens assemblies 12 may comprise various light refraction properties, transmission patterns, or geometries to allow the user to customize the light probe 2 using the lighting device system 1 for one or more desired uses.

As introduced above, the lighting device system 1 may comprise or be configured to couple to a power source 11, a controller 9, and a user interface 10. For example, the controller 9 may operatively couple the user interface 10 to allow a user to control a supply of power provided by the power source 11 to the light elements 6 of the light probe 2. Various embodiments of the controller 9 may comprise light control features such as power switches, dimmer switches, light sequences or selections. The user interface 10 may comprise buttons, knobs, switches, triggers, or other interfaces for interfacing the user with the operations or capabilities of the controller 9, which, in one embodiment, comprises at least one of interfacing the user with dimming, beampattern, and chromaticity control features for providing controllable light.

The controller 9 may be configured to allow light control operations to be performed at each light element assembly 5 or each light element 6 independent of light control operations at other light element assemblies 5 or light elements 6. For example, the controller 9 may be configured to individually address each light element assembly 5, particular light elements 6 of one or more light element assemblies 5 comprising multiple light elements 6, or specific light elements 6. The user may access such functionalities via the user interface 10. In another embodiment, the light elements 6 and light assemblies 5 may be serially wired to the controller 9 or power source 11. In various embodiments, light element assemblies 5, particular light elements 6 of light element assemblies 5, or light elements 6 may be individually wired to the controller 9 or power source 11 or may be wired in parallel. The mechanical or electrical interface 29 may be configured to maintain or establish independent addressability of light elements 6 or light element assemblies.

In certain embodiments of the lighting device system 1, the light probe 2 may be integrated with or comprise a modular component configured to operatively couple with the implement 15. Various embodiments may include adaptors configured to couple the light probe 2 with the implement 15 or multiple implements. Such adaptors may be associated with the light probe, implement, or may be a separate component.

The implement 15 may be configured for user manipulation, e.g., positioning of the light probe 2 and, in some embodiments, may include power and control assemblies such as the controller 9 or the user interface 10 configured for control operations of the light elements. Implements 15 may also comprise or be configured to operatively couple to the power source 11 and controller 9 and thereon provide the user interface 10 to control power or selection of light element 6 operations. In various embodiments, the controller 9 may be integrated or configured for integration with one or more implements 15, such as exploratory devices, to perform multiple tasks. The electronics of the controller 9 and user interface 10 may be provided by the implement 15 or integrated with the probe 2.

In a modular embodiment of the lighting device system 1, the controller 9 may be integrated in whole or in part with the probe 2 or the implement 15. The probe 2 may include the user interface 10 or the user interface 10 may be operatively coupleable to the probe 2, e.g., associated with the implement 15. Implements 15 may comprise marine implements 15 that are generally configured for use within or for interacting with the marine environment. Marine implements 15, for example, may include extensions, arms, tools, submersible equipment or vehicles, or cameras suitable for marine environments and may further include manipulation or attachment points such as brackets, grips, handles, gears, pulleys, robotics, etc.

In at least one embodiment, the body 3 of the light probe 2 forms an extension (not shown) comprising the implement 15 configured to be gripped by a user such that the user may manipulate the position of the light probe 2. Such an implement 15 may be further configured for use in a marine environment and therefore comprise a marine implement 15. The extension may include the controller 9 or the user interface 11 or may be configured to couple to a controller 9 or user interface 10 to allow the user to modulate the light emissions from the light elements 6. Mitigation of backscatter, for example, may be achieved by minimizing the volume of water illuminated in between the desired target and perspective view. In close range underwater applications, the primary absorption losses may also be reduced considerably by placing the light source close to the desired target. Thus, by collocating the light probe 2 with an implement 15, whether comprising a modular or integrated lighting device system 1, designed to explore or interact with the marine environment, the light source of the probe 2 may be placed in close proximity to a target to be illuminated and may maximize the projection of useful light while reducing backscatter.

Figure 2:
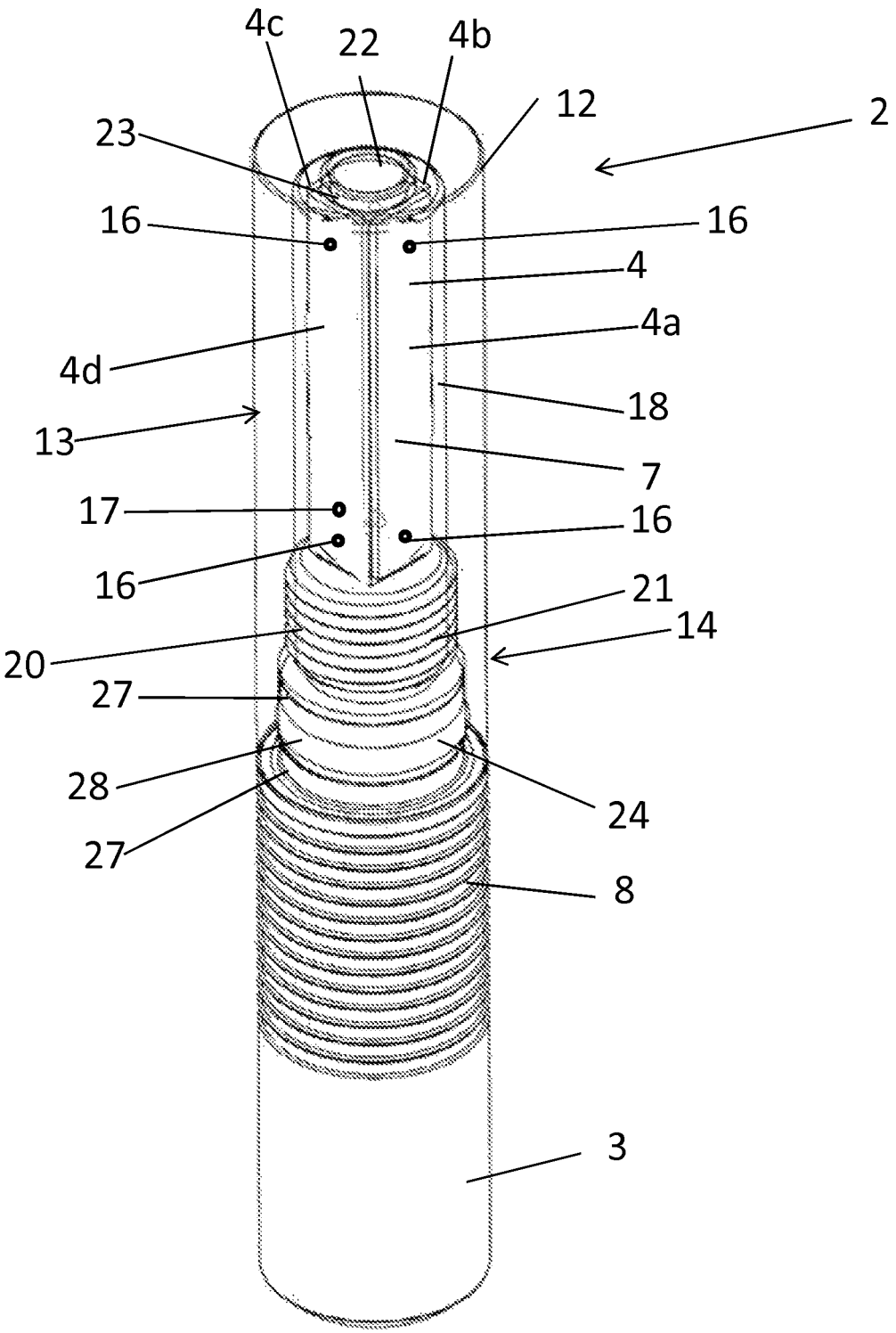
FIG. 2 is a perspective view of a light probe according to various embodiments described herein.
Figure 3B:
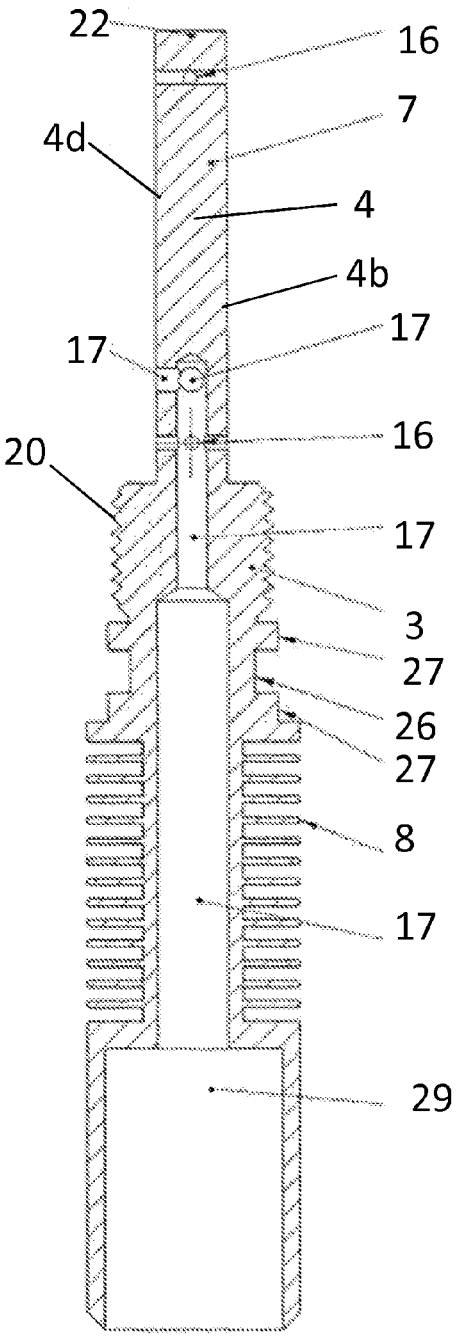
FIG. 3B is a cross section view of the probe body of FIG. 2.
Figure 3A:
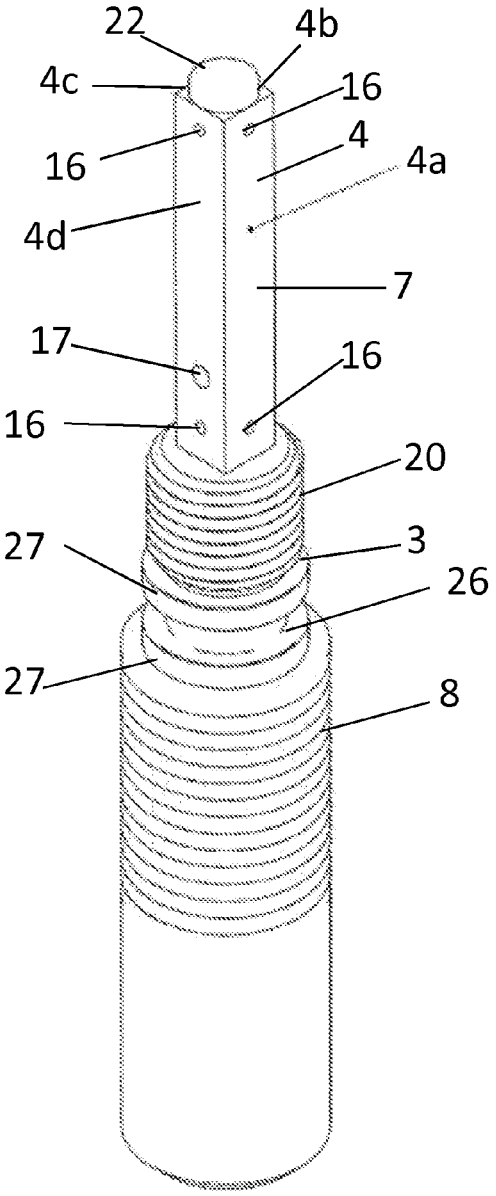
FIG. 3A is an isometric view of the probe body of FIG. 2.
Figure 4B:
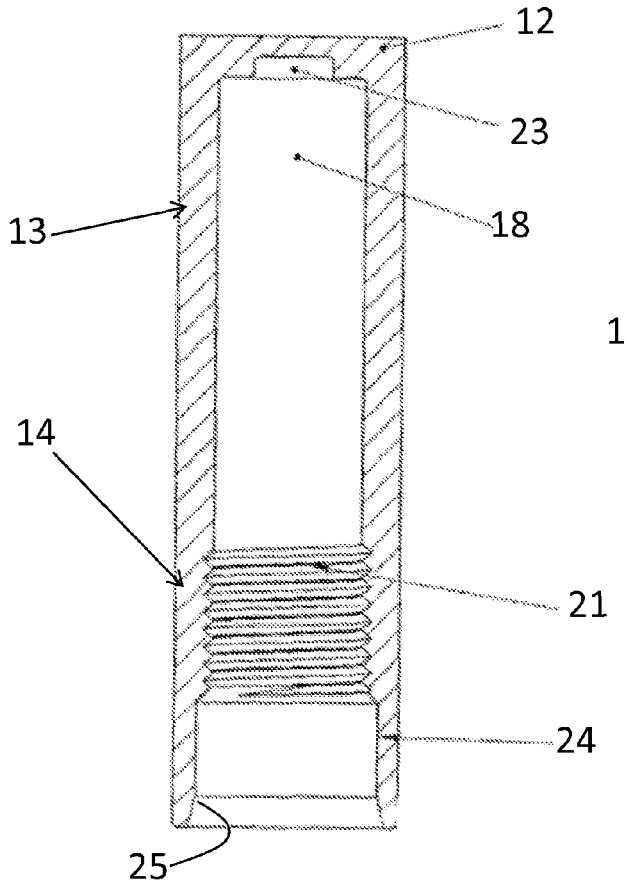
FIG. 4B is a cross sectional view of the lens assembly of FIG. 2.
Figure 4A:
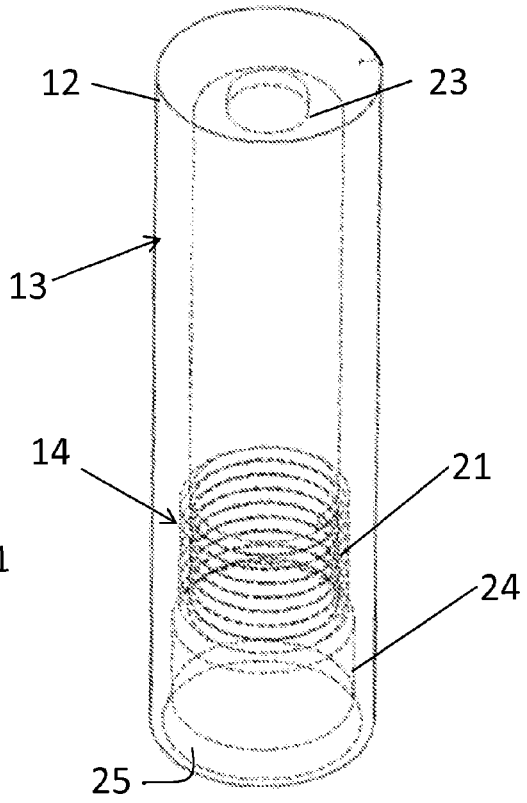
FIG. 4A is an isometric view of the lens assembly of FIG. 2.

FIG. 2 illustrates one embodiment of a light probe 2 comprising a body 3 and a lens assembly 12. FIGS. 3A and 3B provide isolated views of the probe body, while isolated views of the lens assembly 12 are provided in FIGS. 4A and 4B. As described herein, the light probe 2 may comprise a flexible platform for selectively receiving multiple combinations of light elements 6 or light element assemblies 5. Further, the light probe 2 may be configured for modular coupling to one or more implements configured for underwater applications.

The body 3 comprises a longitudinally extending light element mounting base 4 defining a plurality of light element mounting surfaces 4*a*-4*d*. While the illustrated light element mounting base 4 includes a rectangular cross section and includes four laterally facing, with respect to the longitudinal extension of the mounting base 4, surfaces 4*a*-4*d* for mounting light elements, in various embodiments, the light element mounting base may include fewer or additional sides. For example, the mounting base 4 may comprise triangular, circular, arcuate, or other geometric or non-geometric cross-sections. The opposed mounting surfaces 4*a*, 4*c* and 4*b*, 4*d* may be positioned substantially parallel. The surfaces 4*a*-4*d* are oriented about perpendicular to the axis of the probe 2; however, in other embodiments, one or more mounting surfaces 4*a*-4*d* of the mounting base 4 may be oriented at angles greater than or less than perpendicular. In one embodiment, the mounting base 4 includes multiple extensions, each having one or more mounting surfaces 4*a*-4*d*.

Figure 6:
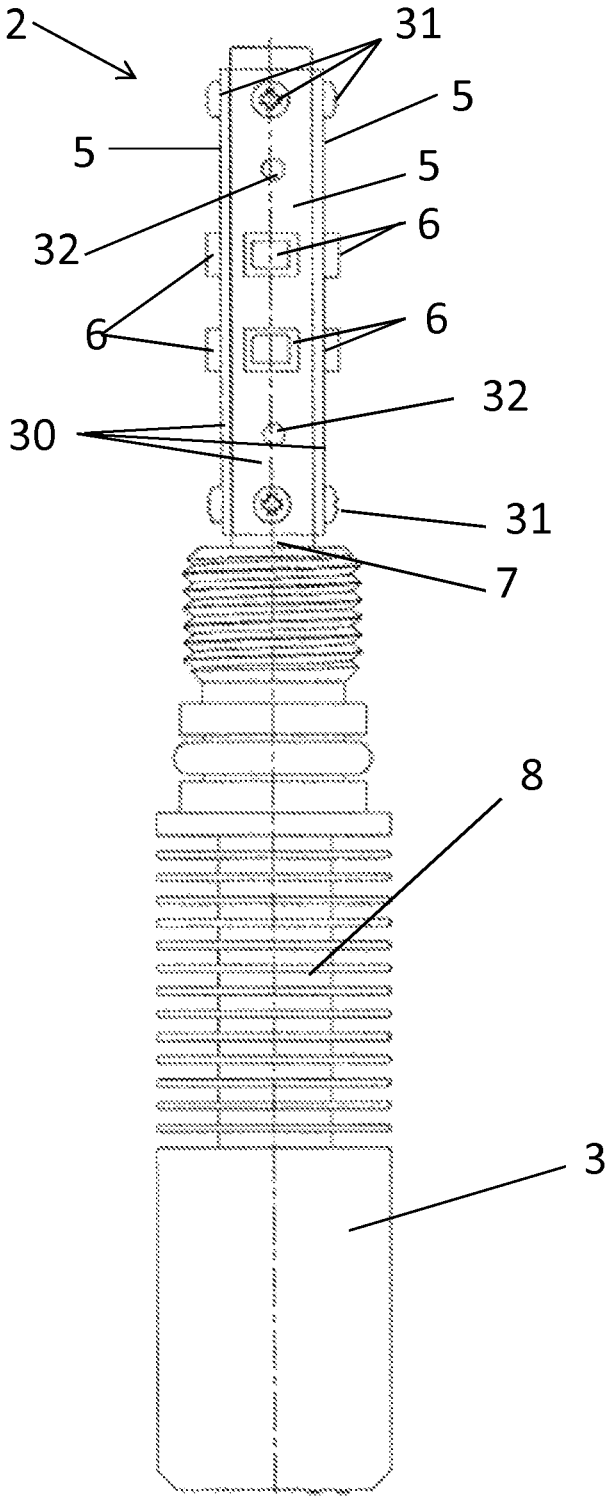
FIG. 6 is a side view of a light probe including the light element assembly of FIG. 5 coupled to a probe body according to various embodiments described herein.
Figure 7:
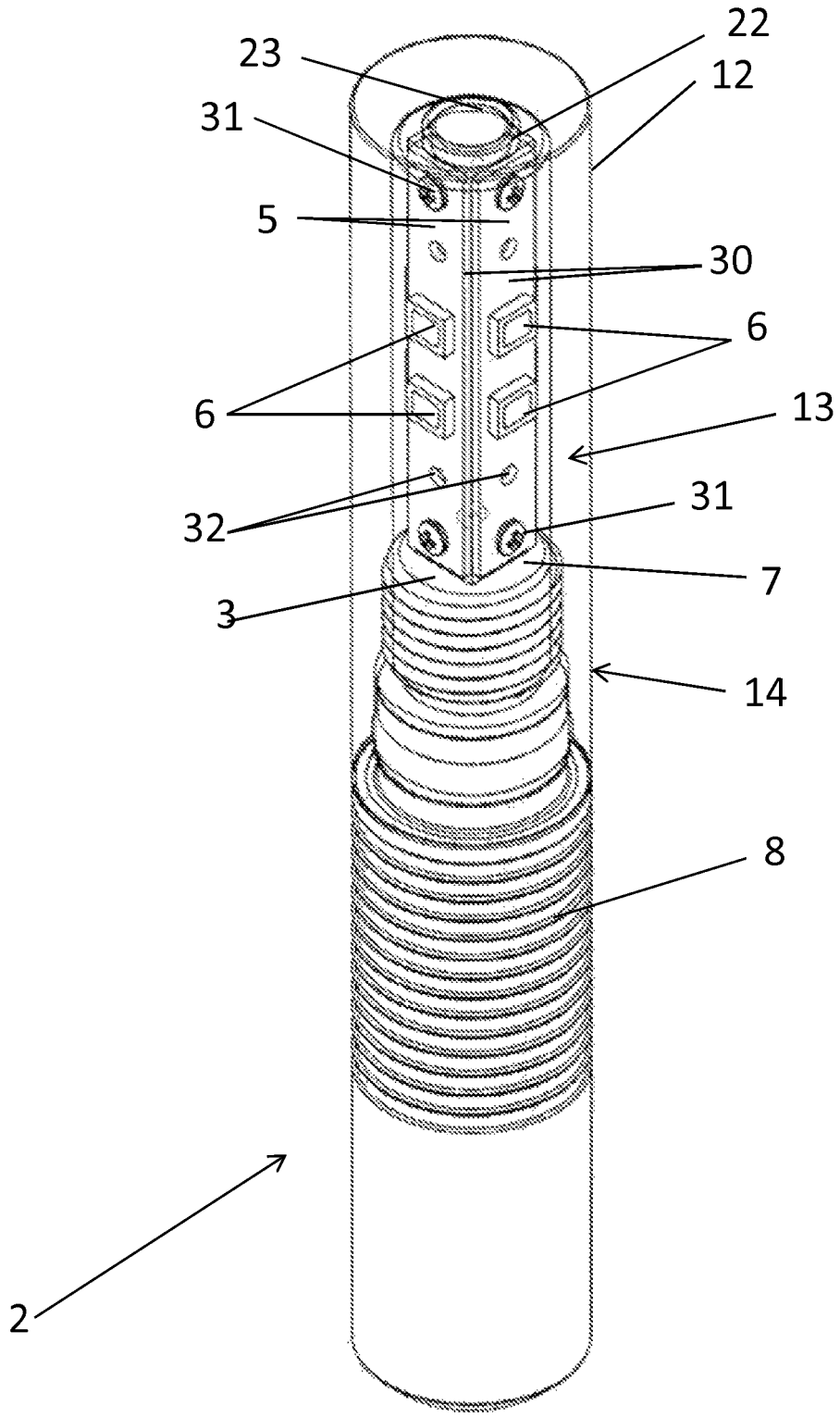
FIG. 7 is an isometric view of the light probe of FIG. 6 further including a lens assembly according to various embodiments described herein.
Figure 8:
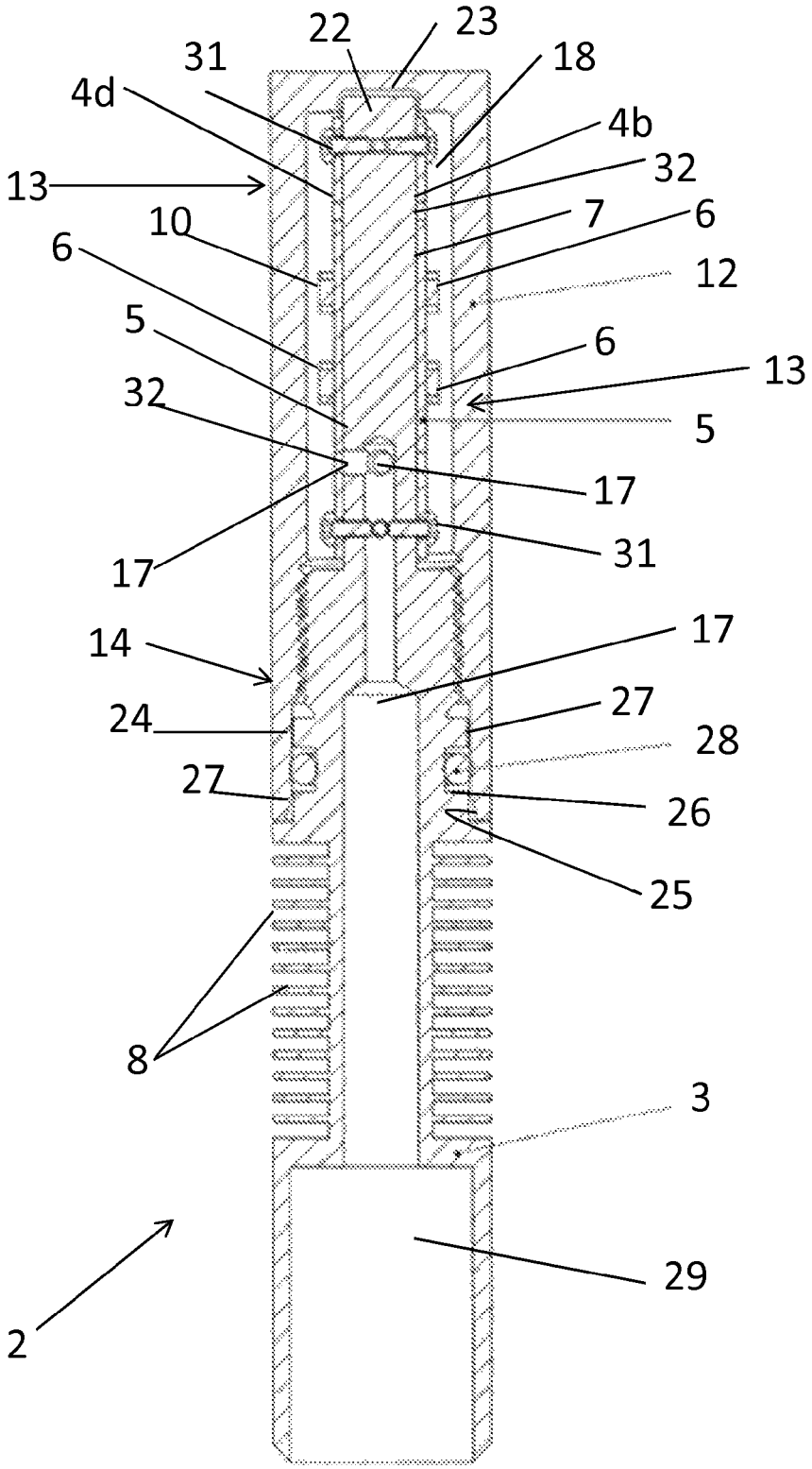
FIG. 8 is a cross section view of the light probe of FIG. 7.

The light element mounting surfaces 4*a*-4*d* include fittings 16 to mount light element assemblies, see, e.g., FIGS. 6-8. The light elements or light element assemblies may be mounted to the light element mounting base 4 directly, as part of a circuit board assembly, as shown in FIGS. 6-8, such as a printed circuit board assembly or a metal core circuit board assembly, or a similar method. For example, in one embodiment, the light elements comprise laterally facing LED arrays directly mounted to the light element mounting base 4.

The body 3 further comprises a heat sink 7 configured to collect generated heat and transfer the heat to the surrounding environment. The heat sink 7 comprises a thermally conductive material. In the illustrated embodiments, the heat sink 7 forms the entirety of the body 3. In other embodiments, however, the body may be formed of different materials or include structures that do not comprise the heat sink 7. The heat sink 7 further comprises heat exchange features 8 configured to enhance heat exchange with the surrounding environment. As shown, the heat exchange features 8 comprise high surface area extensions or fins configured to maximize the heat transfer to the surrounding fluid.

The high thermal conductivity of the heat sink 7 material, which may be an aluminum, or other suitable metallic or plastic with high thermal conductivity, works to conduct the heat away from the light elements mounted along the light element mounting base 4 through the body 3 and ultimately to the surrounding fluid. The heat sink 7 material or combination of materials include thermal impedance designed to provide satisfactory operation to the full capacity of light element LEDs or LED arrays in air and to have substantial design margin for cooling in water such that use in either medium is possible. The thermal transfer of heat generated by light element LEDs is important for both the LED longevity and reliability. Thermal transfer of heat may also result in differential expansion along the sealing interfaces of the lens assembly 12 and the body 3, which may increase or decrease the gland gap, affecting the seal characteristics. Therefore, in certain embodiments, sufficient heat transfer away from the light elements and sealing interfaces may be critical to operation of the light probe 2. To those skilled in the art, there are other approaches and designs that are known and that may be utilized to conduct heat from the light element mounting surfaces 4*a*-4*d* and base 4 for transfer to the surrounding medium that do not depart from this implementation.

The lens assembly 12 is configured to be positioned between the light element mounting base 4 and the surrounding environment. The lens assembly 12 includes a lens portion 13 configured to provide a highly transparent enclosure when mated to the body 3. The lens portion 13 material may be clear polycarbonate, acrylic, lexan, glass, sapphire, quartz, or other resilient and transparent materials. The lens assembly 12 or lens portion 13 may additionally be designed to include color filters, reflectors, etc. to suit the desired application. The material, shape, and position of the lens portion may be selected to provide a desired beampattern, refraction, or light transmission.

The lens assembly 12 further includes a fitting portion 14 configured to sealingly interface with the body 3 to form a watertight seal within the enclosure. For example, the light elements and mounting base 4 may be received within the bore 18 and therein maintained in an airtight volume when the lens assembly 12 is coupled to the body 3. The lens fitting 14 may comprise the same or different materials than the lens portion 13. As introduced above with respect to FIG. 1, the body 3 may be configured to provide a base for the light elements, light element assemblies, or other various electronics assemblies; a mating watertight interface to the lens; a pass through for electrical wiring; and one or more pressure tolerant mechanical or electrical interfaces, e.g., mechanical or electrical interface 29. As shown, the body 3 includes an external thread 20 configured to mate with internal threads 21 defined along the fitting portion 14 of the lens assembly 12. The distal end of the body 3, corresponding to the distal end of the light element mounting base 4, defines a cylindrical extrusion 22 positioned to concentrically align with a bore interface 23 defined in the lens assembly 12 to concentrically align the lens assembly 12 and light element mounting base 4 of body 3 while further securing the lens assembly 12 to the body 3. The concentric alignment may also provide additional support for the lens assembly 12 on the body 3 through the extrusion 22.

As introduced above, the lens assembly 12 may comprise a lens fitting 14 configured to mate to the body 3 and form an airtight enclosure enclosing light elements mounted to the light element mounting base 4. For example, the light elements 6 and mounting base 4 may be received within the bore 18 and therein maintained in an airtight volume when the lens assembly 12 is coupled to the body. The lens assembly 12 and the body 3 may be primarily fastened through the internal thread 21 along the fitting portion 14 and the external threaded fitting 20 of the body 3. The mating threads 21, 22 and interaction of extrusion 22 and bore interface 23 provide mechanical fastening and support for the lens assembly 12 and body 3. Although other methods of providing an airtight seal may be used, in the illustrated embodiments, the fitting portion 14 of the lens assembly 12 defines a bore 24 and a lip 25 defining an enlarged opening that decreases in diameter inward toward the bore 24. The body 3 includes a groove 26 defined between two pistons 27 configured to retain a seal 28, and an o-ring seal is shown. When the lens assembly 12 is coupled to the body 3 about bore 24 and the pistons 27 and groove 26 serve to compress seal 28 to provide a watertight seal. While the preferred embodiment utilizes the described mechanical and pressure tolerant interface, similarly suitable seals may be achieved through methods known to those skilled in the art. Additionally, the assembly 12 bore 18 may be filled with a non-conductive incompressible fluid such as mineral oil to provide a pressure compensated system. Such a pressure compensated system may increase pressure tolerance if extreme pressure tolerance is required. This method may be used to remove an implosive volume formed within the light probe 2 when the lens assembly 12 is sealed to the body 3. In embodiments including a modular lens assembly 12, the bore 18 may be filled or partially filled with a volume of the non-conductive incompressible fluid prior to sealingly coupling the lens assembly 12 to the body 3. Sealingly coupling the lens assembly 12 the body 3 may include inserting the light element assembly mounting base 4 and light elements 6 into the bore 18 wherein the mounting base 4 and light elements 6 become surrounded by the fluid therein.

The lens assembly 12 may be configured for ease of replacement to account for wear and damage that may degrade optical clarity along the lens portion 13. For example, the embodiment shown in FIGS. 2-4B comprise a lens assembly 12 and body 3 configuration designed for ease of replacement of the lens assembly 12, e.g., to account for wear and damage incurred by dual usage as a probe, instrument, or tool interacting with a marine environment. The lens assembly 12 is also made to be removable, such that modular embodiments may be utilized or substituted to achieve additional or different functionality. For instance, in one embodiment, the lens assembly 12 includes an interface configured to operatively couple to an implement. For example, in one such embodiment, an implement in which the interface of the lens assembly 12 is configured to operatively couple is a tool which may be used to perform work or interact with desired objects in an underwater environment. In applications that do not include removability of the lens assembly 12, the lens assembly 12 may be permanently fixed to the body 3 by any known method.

The light element mounting base 4 extends longitudinally and defines four laterally facing light element mounting surfaces 4*a*-4*d* each including mounting fittings 16 defining internal threads to secure light elements 6 or light element assemblies 5, such as one or more LEDs or LED arrays to the body 3, see, e.g., FIGS. 6-8. The body 3 includes various conduits 17 to route wiring. It is to be appreciated that these conduits 17 and mounting features 16 may be modified to suit a desired wiring and light element configuration.

Figure 5:
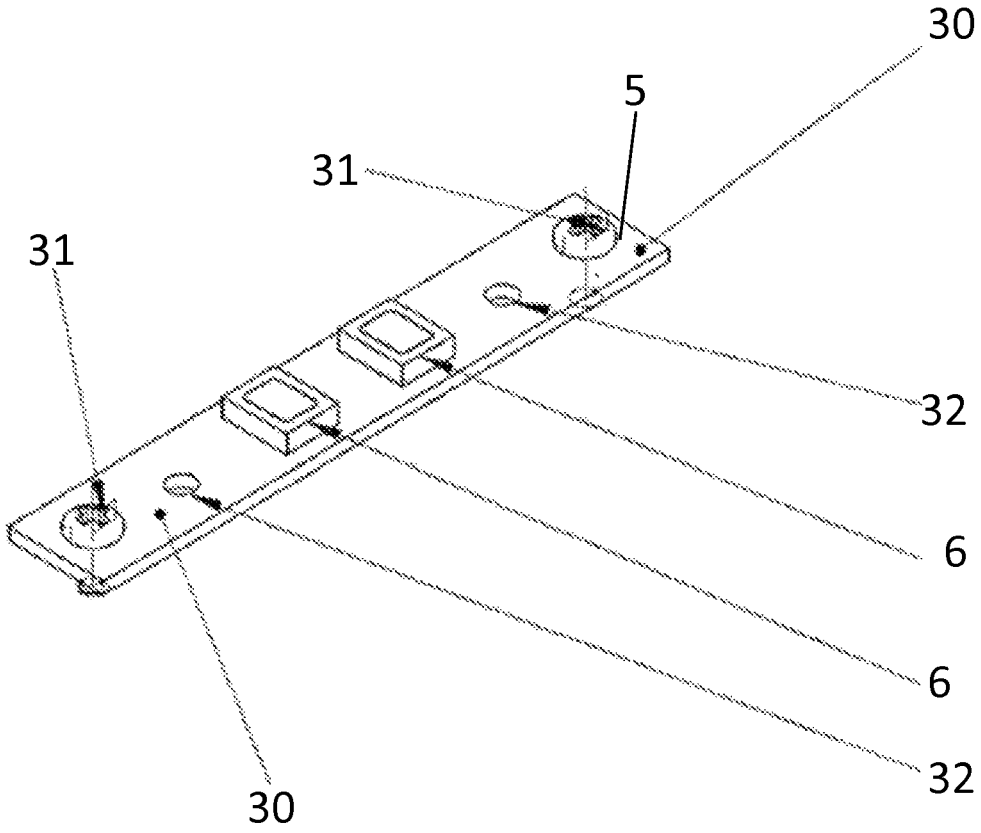
FIG. 5 is an isometric view of a light element assembly according to various embodiments described herein.

FIG. 5 illustrates one embodiment of a light element assembly 5 comprising two light elements 6. The light elements 6 preferably comprise LEDs or LED arrays. As shown, the light element assembly 5 comprises a light element assembly board 30 comprising a base metal core circuit board, surface mount pads for one or more light elements 6 comprising LEDs or LED arrays, plated or non-plated through holes (not visible) for mounting with screws 31, pins, connectors, or pads for board to board connectivity, and through holes 32 for input power wiring pass through. Those skilled in the art will realize the light element assembly 5 may instead utilize a typical printed circuit board assembly with additional thermal path features, direct LED to body mounting through custom sockets or fixtures, other metal core circuit board LED array designs, etc. The light element assembly 5 or light elements 6 may provide electronics for independent addressability, as described above.

FIGS. 6-8 illustrate various views of a light probe 2 comprising the light element 5 of FIG. 5. The light probe may be similar to the light probe 2 shown and described above with respect to FIGS. 2-4 wherein like features are indicated with like numerals and all details of such features may not be repeated. Briefly, the body 3 may be configured to provide a pressure tolerant interface to the lens assembly 12; mechanically fixture and retain the lens assembly 12 in a concentric manner; and circumscribe seal 28, which may be an o-ring, as described above. The body 3 may further comprises a longitudinally extending light element mounting base 4 configured to support a plurality of light elements, four parallel light elements 6 or light element assemblies 5 are shown. The body 3 comprises a heat sink 7 configured to transfer heat from the light elements 6 and dissipate the heat to the surrounding medium through the heat exchange feature 8. For instance, the heat sink 7 forms a longitudinally extending light element mounting base 4 positioned to receive heat transfer from the lighting elements 6 for transfer to surrounding fluid through the heat exchanger feature 8. The body 3 may further include one or more pressure tolerant mechanical or electrical interfaces for integration to a power source, instrument, system, etc. through a screw 31 or like fastener to optimize thermal transfer from the light elements 6 to the heat sink 7, and to mechanically fixture the light element assemblies 5.

Conduits 17 are available to route wiring from the light elements to the electrical and mechanical interface 29. These conduits 17 and mounting features 16 may be modified to suit the desired wiring and light element 6 or light element assembly 5 configurations, which may include wiring for independent addressability, serial, or in parallel, for example. Additionally, the body 3 may include conduits 17 to route wiring from the light element assemblies 5 to the electrical and mechanical pressure tolerant interface. The piston 27 and groove 26 features of the body 3 accept an o-ring seal 28 and seal against the bore 24, as described above, such that the light elements 6 and enclosed space provided by the lens assembly 12 are watertight when the electrical or mechanical interface 29 is mated in a pressure tolerant manner to another assembly, such as an implement, or encapsulated or potted or filled in a watertight manner known to those skilled in the art.

The lens assembly 12 contains several features that are integral to the beampattern, the sealing interface, and mechanically robust and pressure tolerant fastening to the body 3. To augment the desired controllable omnidirectional beampattern the lens portion 13 defines a cylindrical shape to maximize transmission of light through the lens portion 13 interface. For example, the cylindrical shape may provide an interface to the lens material along the lens portion 13 and surrounding water or fluid that is substantially perpendicular to the light source of the light element 6 in all directions, to maximize transmission of light through the interface. In other embodiments, the lens portion comprises other cross sections that are not cylindrical, but rather are triangular, rectangular, or other geometric, non-geometric, regular, or irregular.

It will be apparent to those having skill in the art that the light probe 2 may comprise a flexible platform system from which various configurations of light element assemblies 5 and light elements 6 may be operatively coupled. The light elements 6 may be mounted to the mounting base 4 in a generally lateral facing direction or another direction either through another orientation of the mounting surface or through an alternative positioning angle applied to the light element 6 or light element assembly 5. The system may include multiple interchangeable and selectable light element assemblies 5 comprising light elements 6, such as LED light sources including LED arrays, comprising various configurations of light element arrays, layouts, or geometries. In one embodiment, for example, the system includes a light element mount extension to provide additional or different orientations of mount surfaces 4*a*-4*d*, including additional mount surfaces, for receiving light element assemblies. The light probe 2 may be configured to attach the extension, via threads, for example, defined at the distal end of the body 3. Similar to the heat sink 7 of the body 3 along the longitudinally extending light element mounting base 4, the extension may further comprise a suitable thermally conductive material to conduct generated heat to the heat sink 7. The extension may therefore comprise an extension to the heat sink 7. The system may further comprise multiple or additional configurations of lens assemblies dimensioned to accommodate the various configurations of light element assemblies 5 and light elements 6. Accordingly, an extension may be used to mount additional light sources to achieve additional beampatterns through modification of the body 3, e.g., the light element mounts 4 and heat sink 7, and the lens assembly 12, e.g., through selection or addition of other lens assembly configurations.

Figure 9:
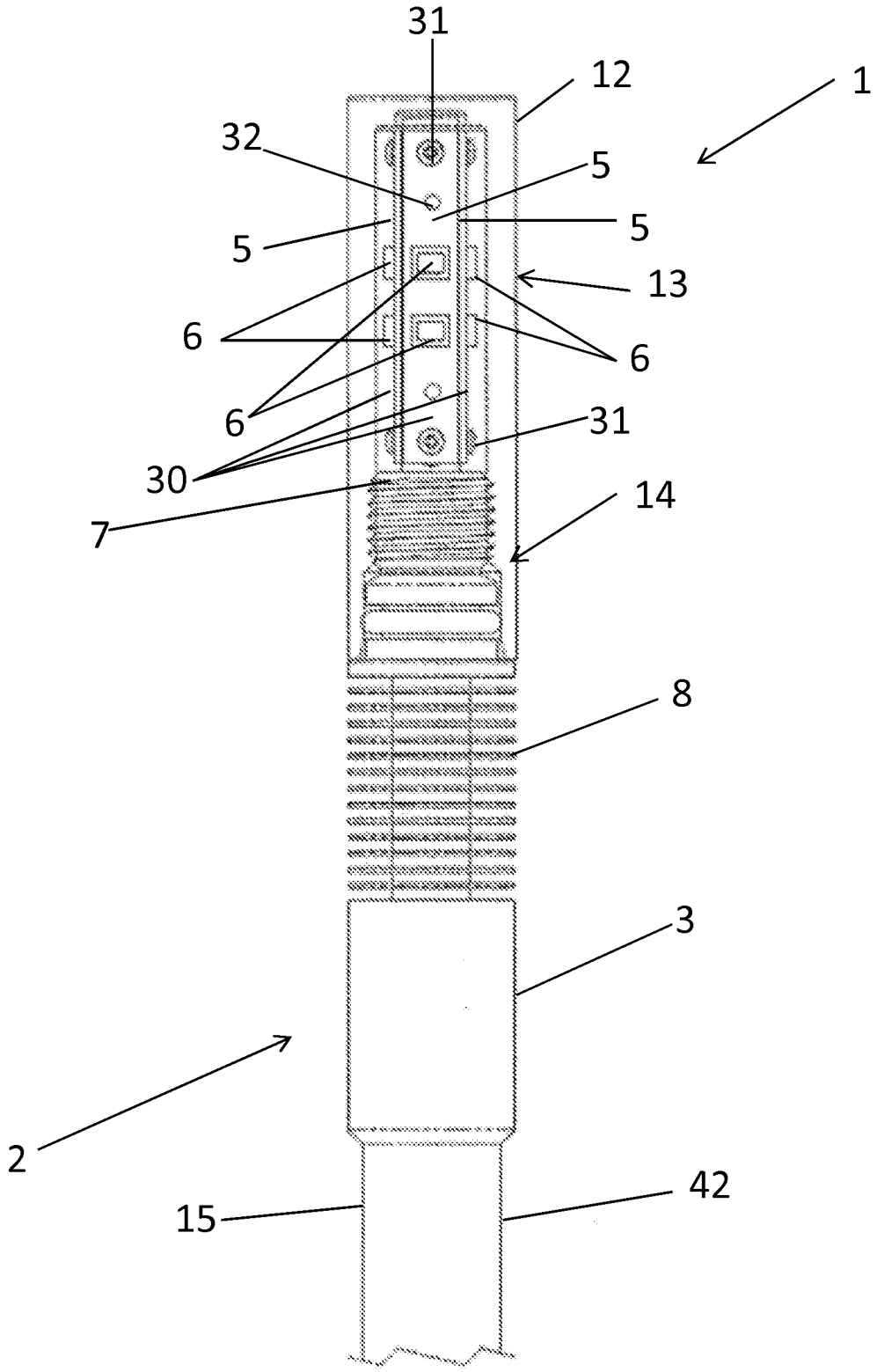
FIG. 9 is a side view of a lighting device including the light probe of FIG. 6 coupled to an assembly according to various embodiments described herein.
Figure 10:
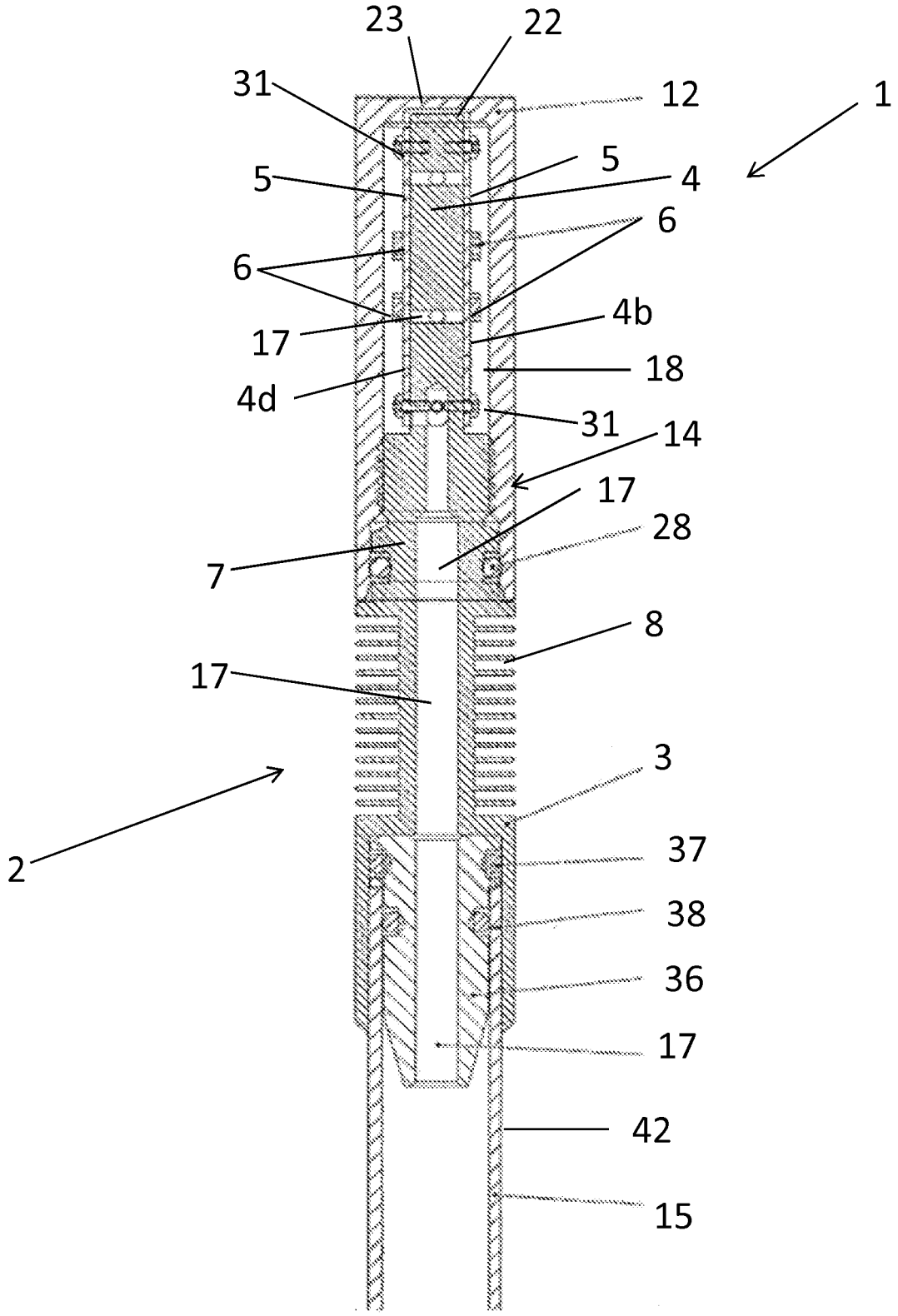
FIG. 10 is a cross section view of the lighting device of FIG. 9.

FIGS. 9 and 10 illustrate one embodiment of a lighting device system 1 comprising a light probe 2 coupled to an implement 15. The electrical or mechanical interface 29 of body 3 includes an interference fit bore with an electrical power and signal pigtail, such that the body 3 seals and fixtures on the implement 15 assembly being pressed onto a mating cylindrical extrusion or retained with one of several retaining compounds known to those skilled in the art. The interface 29 is mated to a cylindrical fitting 42 with the use of an adapter 36, sealing o-rings 37, 38 and may be held together by a press-fit or retaining compound method, or one of several suitable methods known to those skilled in the art. This interface 29 represents one of several potential interfaces that range from a wet mate electrical connector to a barb fitting for attachment to a pressure balanced oil filled assembly. To those skilled in the art this interface is understood as a modular interface that may be tailored toward the desired application. In some applications, this interface 29 may be potted or directly coupled to a power supply, implement, or cable.

Figure 11A:
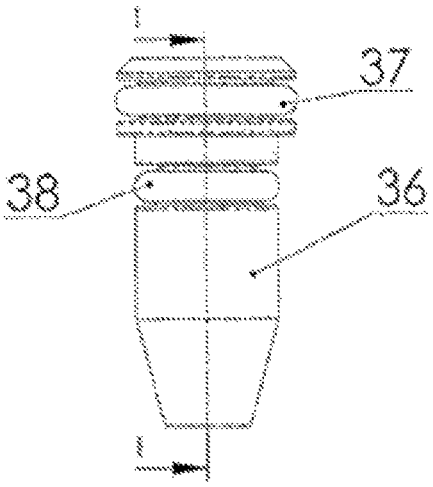
FIG. 11A is a side view of an adapter fitting according to various embodiments described herein.
Figure 11B:
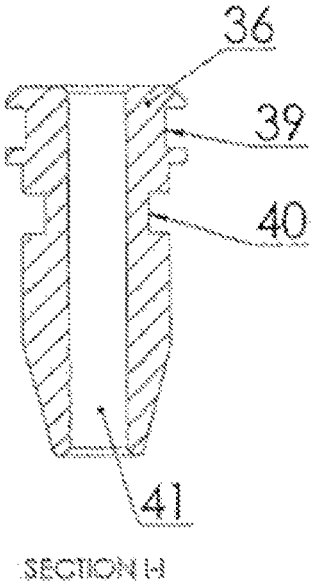
FIG. 11B is a cross section view of the adapter fitting according to various embodiments described herein.
Figure 11C:
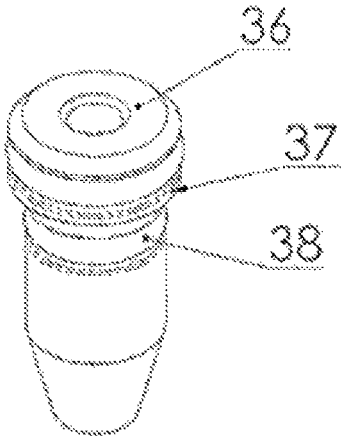
FIG. 11C is an isometric view of the adapter fitting according to various embodiments described herein.

FIGS. 11A-11C provide additional views of the adapter fitting, which may be utilized to mount the interface 29 to an implement 15 which may include a power and control assembly including cylindrical fitting 42.

Figure 12:
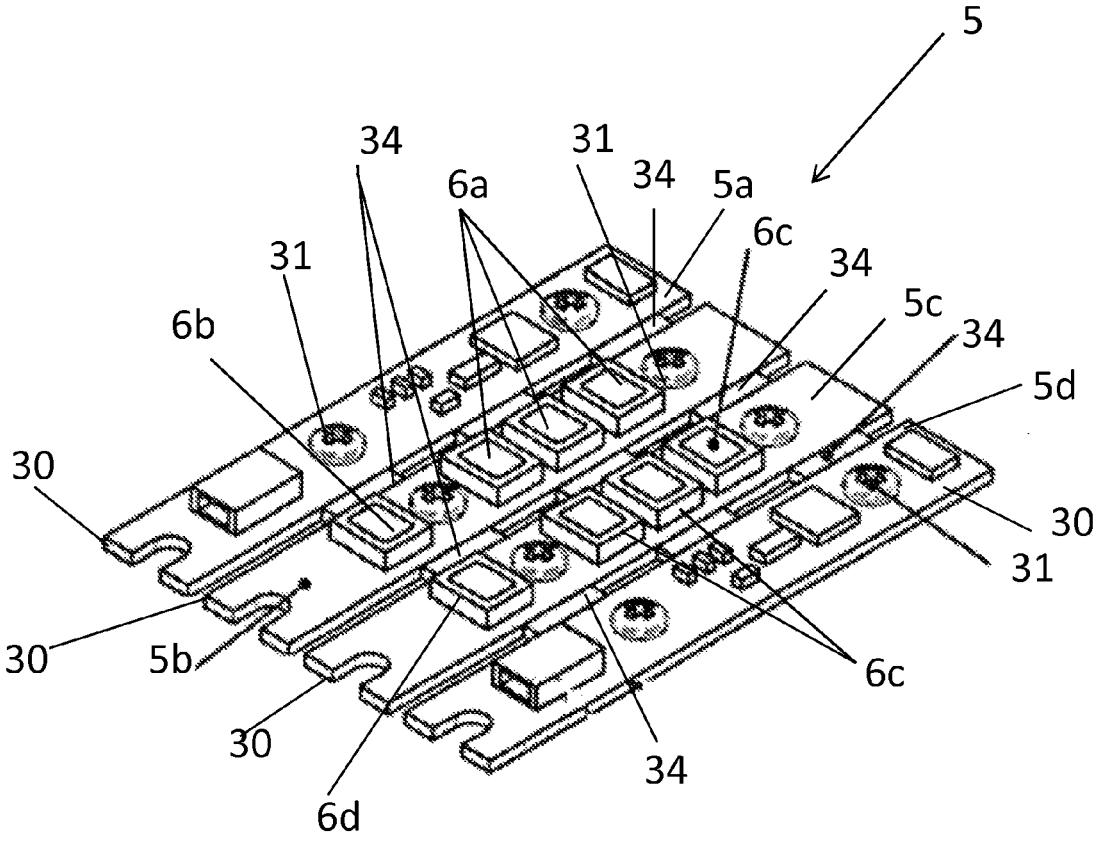
FIG. 12 is an isometric view of a light element assembly according to various embodiments described herein.

FIG. 12 illustrates a light element assembly 5 comprising a plurality of coupled assemblies 5*a*-5*d*. The light element assembly 5 comprises a rigid flex printed circuit board with light elements 6*a*-6*d* comprising the LED array and control electronics on the printed circuit board 30 and includes flex material 34 at the interfaces between the four rigid board section assemblies 5*a*-5*d*. The light elements 6*a*-6*d* may comprise an LED array of six white LEDs 6*a*, 6*c* and two red LEDs 6*b*, 6*d*; however, additional LED arrays and colors may be used. The light element assembly 5 or light elements 6*a*-6*d* may be configured for independent addressability as described above.

Figure 13:
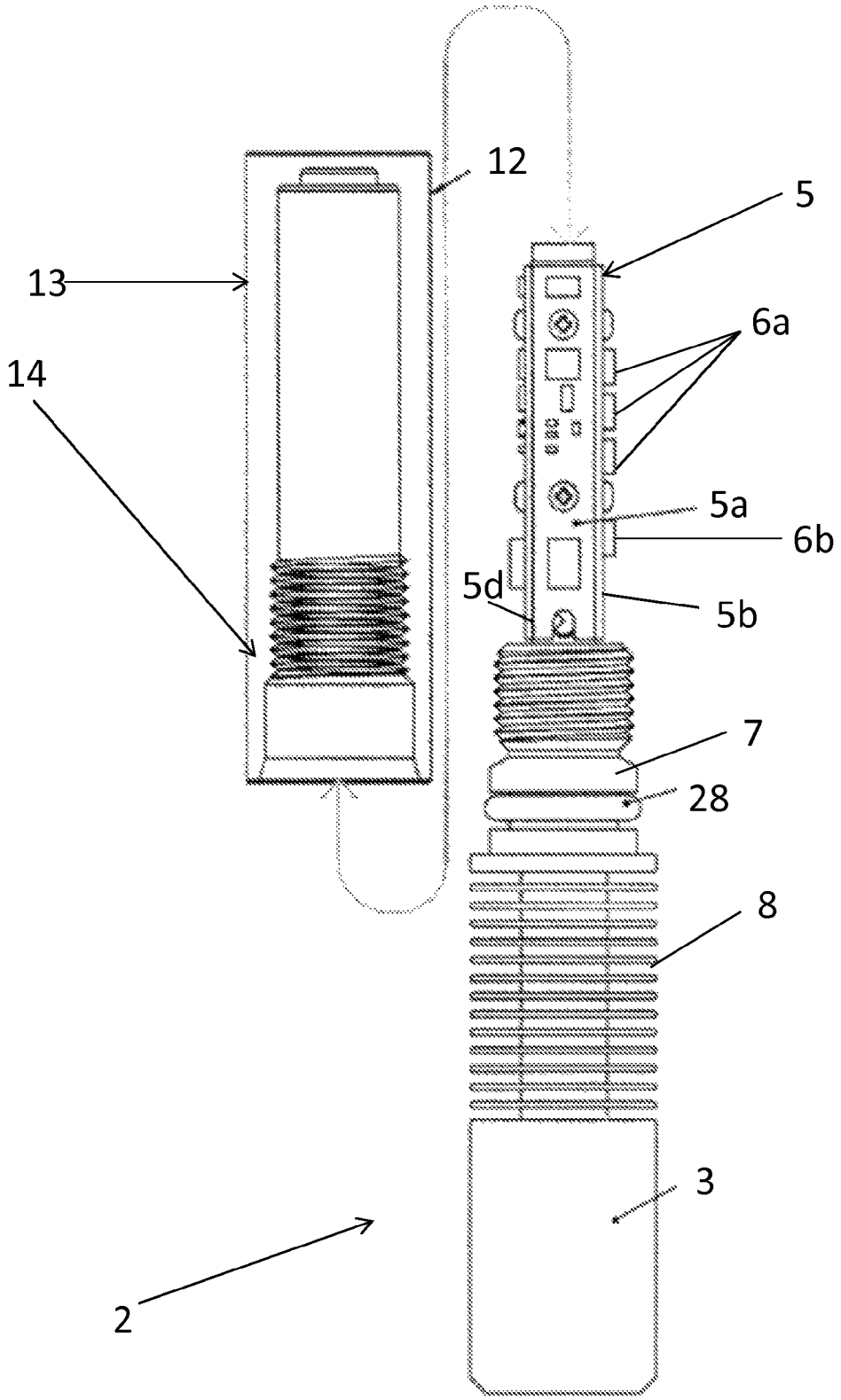
FIG. 13 is a side view of a light probe including the light element assembly of FIG. 12 with the lens assembly removed according to various embodiments described herein.
Figure 14:
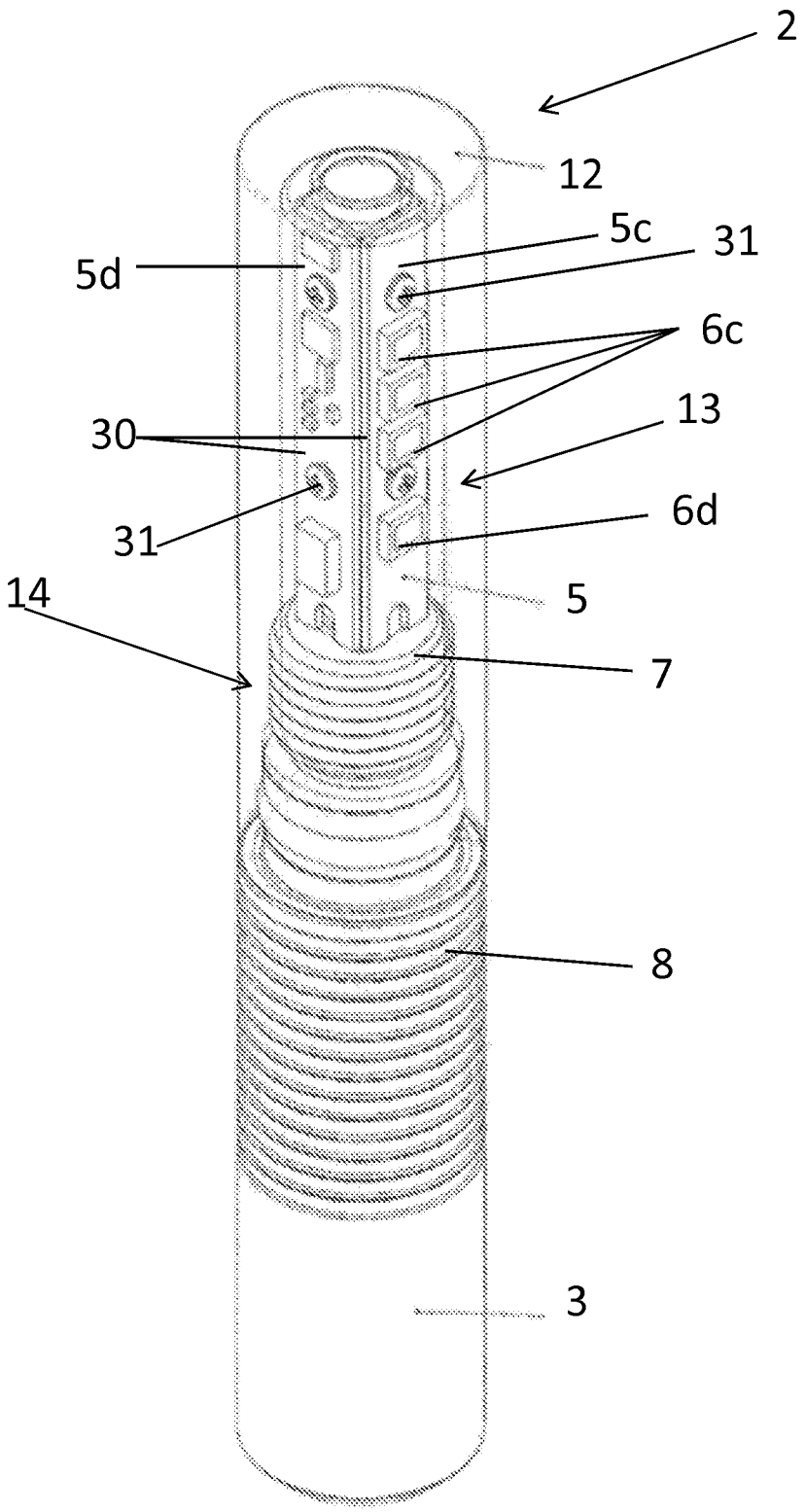
FIG. 14 is isometric view of the light probe of FIG. 12 with the lens assembly coupled to the probe body according to various embodiments described herein.
Figure 15:
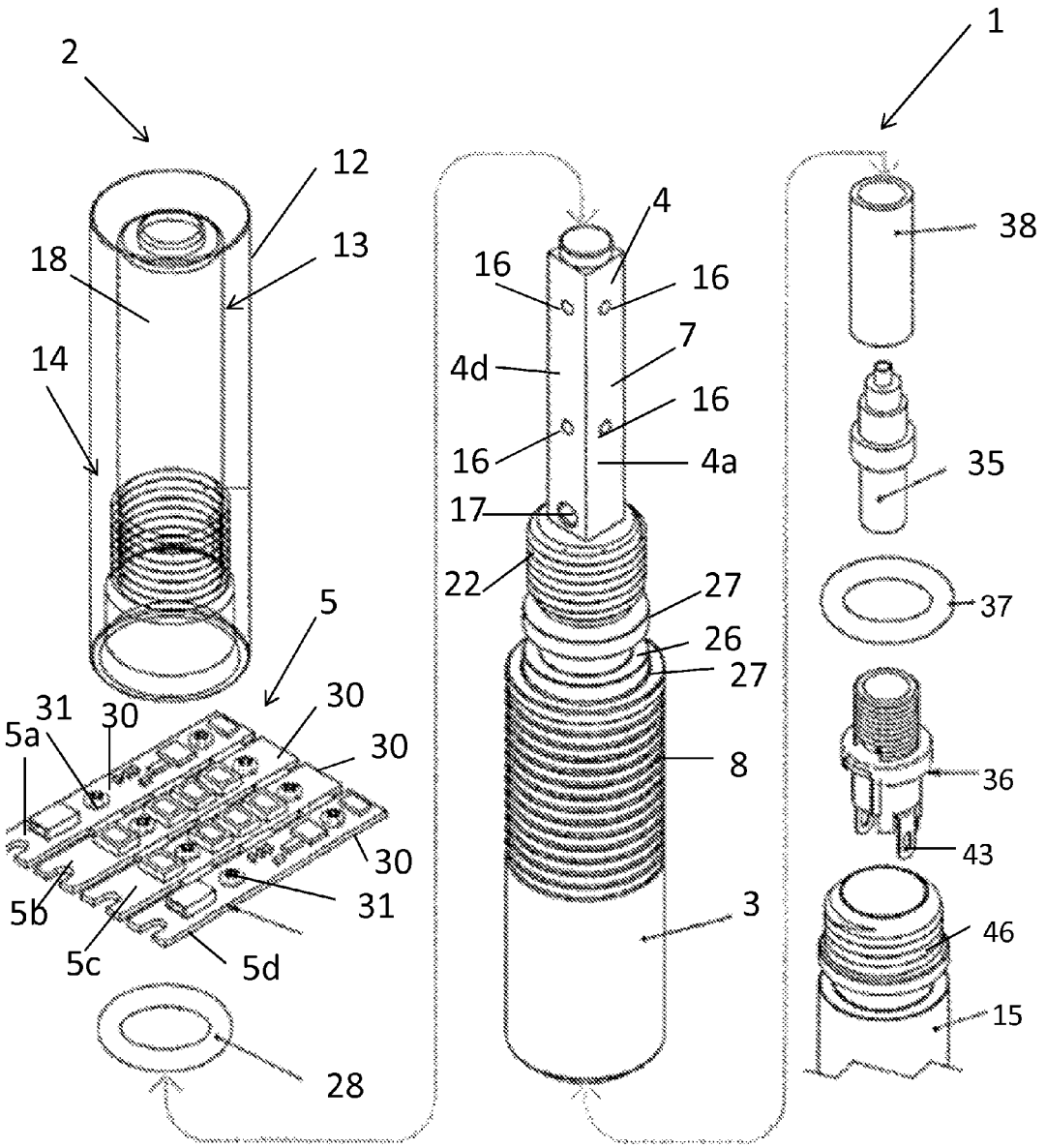
FIG. 15 is an exploded isometric view of a lighting device comprising the light probe of FIG. 14 coupled to an assembly according to various embodiments described herein.
Figure 16:
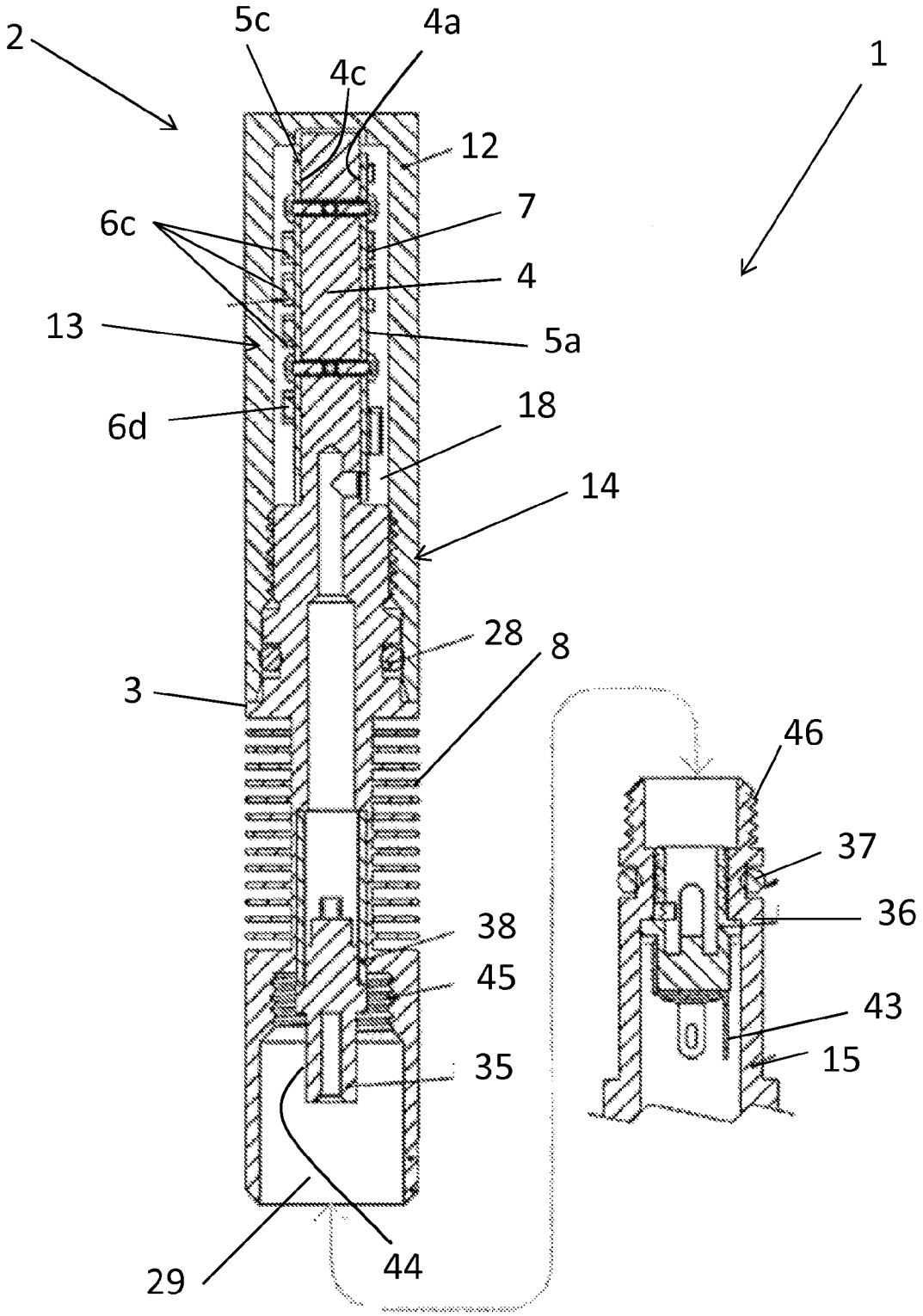
FIG. 16 is a cross section view of the lighting device of FIG. 15 decoupled according to various embodiments described herein.

FIGS. 13 and 14 illustrate a light probe 2 comprising the light element assembly 5 of FIG. 12. FIGS. 15 and 16 illustrate a further embodiment of a light device system 1 comprising a light probe 2 and a connector interface adaptor 35 configured to couple to an implement 15 assembly via a threaded adaptor 36. The light probes 2 shown in FIGS. 13-16 may otherwise be similar to the light probe 2 described above with respect to FIGS. 2-8. In one implementation, this embodiment is configured to provide compact electrical connectivity for advanced controllability and features of the LED array. The light elements 6*a*-6*d* may contain separately dimmable electronics so that the chromaticity, brightness, and beampattern may be controlled through the connector interface adaptor 35 by powering the light elements 6*a*-6*d* with different drive currents. The connector interface adaptor 35 includes coupling interface extension 44 and mating threads 45 configured to mate with a corresponding mating thread 46 associated with assembly 33 and a seal formed by a seal 37, e.g., an o-ring, with the bore defined in the electrical or mechanical interface 29 of the body 3, along with a concentrically aligned barrel electrical connection of the connector interface adaptor 35 mounted to electrical insulator 38 which may be pressed into the body 3. The adaptor 36 may include electrical contacts 43 for electrically coupling the light probe 2 electronics to a power source, controller, or user interface. The adaptor 36 may be configured to provide independent addressability through the interface when coupled. The embodiment illustrated in FIGS. 15 and 16 is configured to allow for the quick removal of the light probe 2 from the implement 15 assembly such that a modular capability is achieved.

In an additional embodiment, LED driver electronics and a battery power source are designed to fit into the bore of the electrical mechanical interface 29 of the body 3, such that the lighting device system is contained in one assembly. This design may facilitate the use of light probe 2 in several underwater applications including combination of probes 2 into arrays.

Figure 17:
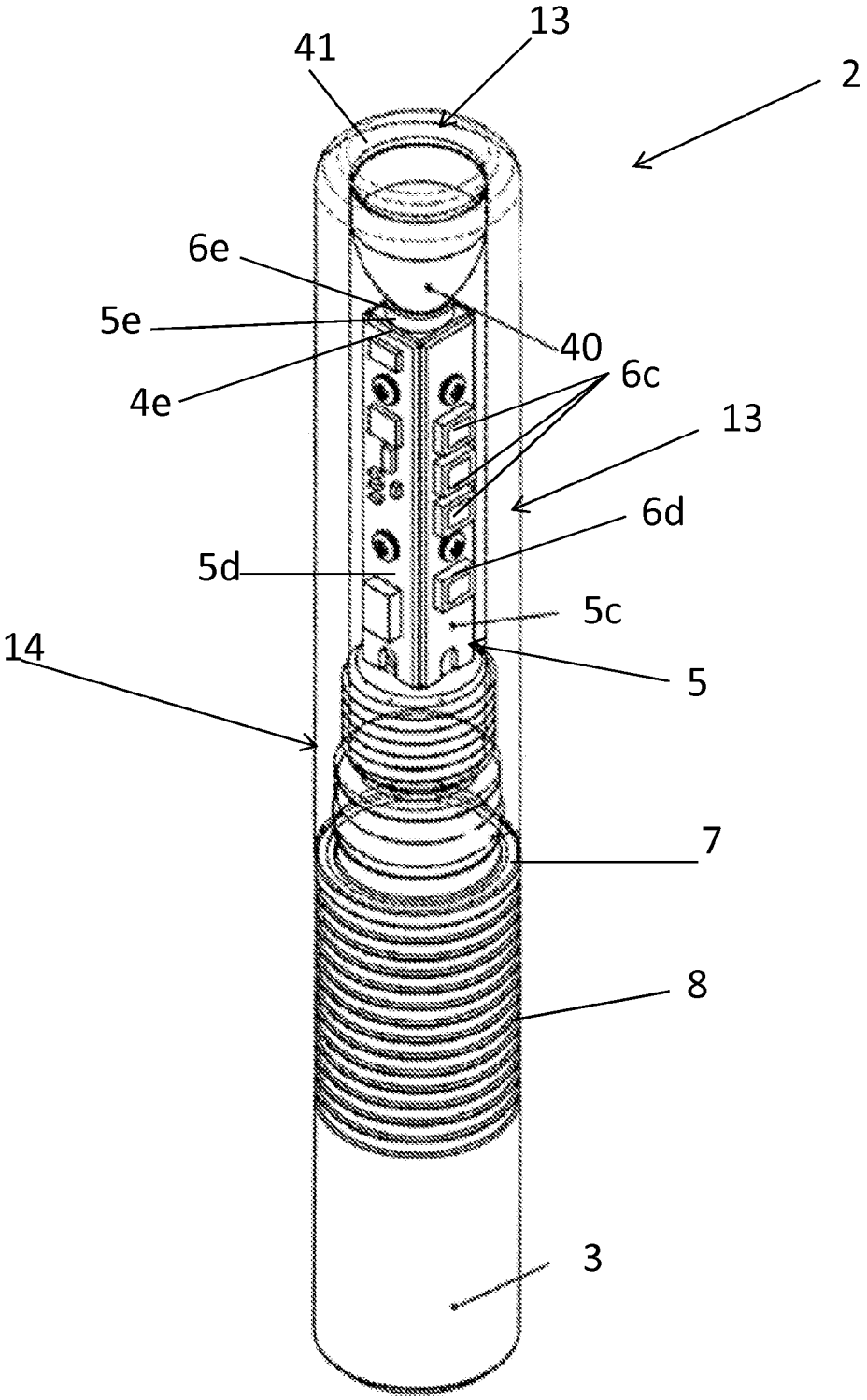
FIG. 17 is an isometric view of a light probe according to various embodiments described herein.
Figure 18:
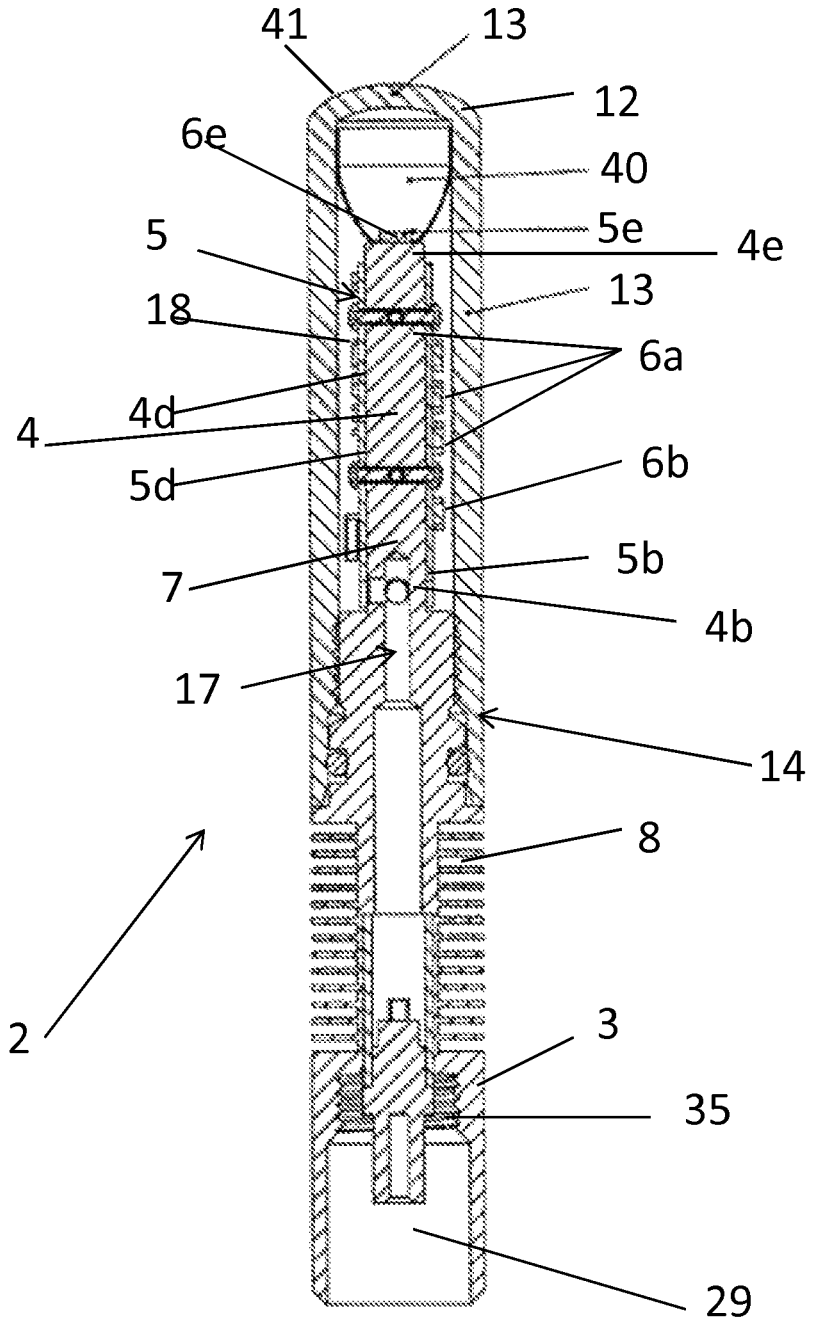
FIG. 18 is a cross section view the light probe of FIG. 17 according to various embodiments described herein.

As introduced above, in various embodiments, the system 1 comprises one or more reflector assemblies. Reflector assemblies may comprise reflectors to control light emitted from one or more light elements 6. Reflectors may include separate lenses, e.g., in addition to lens assembly 12, that may be integrated with the light elements 6 or be selectively coupled to light elements 6. FIGS. 17 and 18 illustrate one embodiment of the system 1 wherein the light probe 2 comprises or is configured to selectively couple a reflector assembly 40. The system 1 may include multiple interchangeable and selectable reflector assemblies 40. For example, the light probe 2 may be configured to interchangeably receive different configurations of reflector assemblies 40 to modify beampatterns. The reflector assembly 40 may be used to achieve additional beampatterns in addition to or instead of other methods to achieve additional beampatterns described herein such as mounting light element assemblies 5 having different light element 6 arrays, layouts, or geometries; coupling of extensions to mount additional light sources to achieve additional beampatterns through modification of the body 3 and selection of suitable lens assemblies 12. As shown, the distal end of the longitudinally extending mounting base 4 may include an additional light element mount 4*e* configured to receive a light element assembly 5*e* comprising one or more light elements 6*e*. The light element 6*e* may comprise an LED or LED array as described above. The light element 6*e* may be positioned at the distal end of the mounting base 4 at a longitudinally facing mounting surface 4*e* which may include the cylindrical extrusion 22. The distal end of the lens assembly 12 may be modified to form a spherical or concave end 41 to provide an optimal optical lens to water (or other surrounding fluid) interface, while improving distribution of light throughout the beampattern, or focusing the light field.

The illustrated embodiment may include coupling of the reflector assembly 40 about the additional light element 6*e*, e.g., one or more LED arrays, such that the overall lighting capabilities of the assembly includes an independently addressable, e.g., separately controllable, longitudinally directed focus light at the distal end and an independently addressable, e.g., separately controllable, hemispherical array along a multiple sides of the light probe 2, e.g., emitted from laterally facing light elements 6*a*-6*d* of light element assemblies 5*b*, 5*c*. The light element assemblies 5*a*-5*e* or particular light elements 6*a*-6*e* may be individually wired to the controller or power source or may be wired in parallel. The mechanical or electrical interface 29 may be configured to maintain or establish independent addressability. This particular embodiment may be configured for a dual use scenario that includes diving and photography wherein the light elements 6*a*-6*d* or their associated light element assemblies 5*a*-5*d* are addressable independent or separately of light element 6*e* or light element assembly 5*e*. While the diver is not photographing, the reflector assembly 40 including light element 6*e* may be dialed to full brightness and the hemispherical array including light elements 6*a*-6*d* may be disabled to provide a high performance focus light. When the diver instead takes a photograph, the hemispherical wide angle LED array including light elements 6*a*-6*d* may be utilized to provide an evenly distributed fill light. The lens in this embodiment comprises a concave end 41.

It will be appreciated that reflector assemblies, reflectors, or separate lenses may be positioned to reflect light emitted from any of the light elements 6, e.g., laterally facing light elements 6, including one or multiple light elements 6 to modify the directivity of the emitted light. Thus, the light probe 2 may be configured to couple to various modular reflectors to create different beampatterns. For example, in one embodiment, some or all of the light elements 6, e.g., LED or LED arrays, couple with or integrate individual reflectors to create flexibility to control the light field projected by the probe 2. In one such embodiment, the individual reflectors may be positioned to control the light field such that the light field extends to some or all faces to project directed, omnidirectional, narrow, wide, hemispherical, circumferential or other desired beampattern. For example, at least one of the LEDs or LED arrays may include or be selectively coupled to a reflector or separate lens to control emitted light to, e.g., into or away from, an adjacent face. The reflectors or separate lenses may be configured to mount to the lens assembly 12, light elements 6, light element assemblies 5, or light element mounting base 4.

Upon reading the present disclosure, those having skill in the art will appreciate that the herein described light device system 1 and light probe 2 fill a gap in underwater LED technology and may be used to provide a compact illuminated instrument with the capacity to project useful light onto a desired object, while providing the ability to interact with the underwater environment. The control features and interchangeability features allow multi-task use of the light probe 2. In addition, modular coupleability to additional assemblies comprising implements such as extensions allows selective and improved placement of the light probe 2 in an optimal position for underwater lighting, due, for example, to the compact size and modular design of the probe 2 and the light device system 1. Finally the controllable beampattern, chromaticity, and dimming embodiments allow for fine tuning of lighting for specific applications such as photography, or for multipurpose capabilities, such that in one mode the light will perform for a set of specific requirements and in other modes the light will perform for an entirely different set of independent or related requirements, in affect offering a multifunctional light.

It is to be appreciated that the preceding description pertains to various preferred embodiments and, as evident by the subsequent description of the modular multipurpose design, there exists a myriad of alternatives dependent on the principals unique to this invention.

This disclosure describes various elements, features, aspects, and advantages of various embodiments of the lighting systems, apparatuses, and methods thereof. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects. Any references to "various embodiments," "certain embodiments," "some embodiments," "one embodiment," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment." Furthermore, the phrases "in one such embodiment" or "in certain such embodiments," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

It will be further appreciated that for conciseness and clarity, spatial or relative terms such as "vertical," "horizontal," "upper," "lower," "lateral," "longitudinal," and others may be used herein with respect to the illustrated embodiments. However, light probes may be used in many orientations and positions, as such, these terms are not intended to be limiting and absolute. All numerical quantities stated herein are approximate unless stated otherwise, meaning that the term "about" may be inferred when not expressly stated. Additionally, in some illustrative embodiments, dimensions including a parameter, measurement, diversion, or range may be given. It is to be understood that any such parameter, measurement, diversion, or range is provided as an illustrative example or instance of an embodiment and is not intended to limit that or other embodiments. For example, unless otherwise specified, illustrations of dimensions and how such parameters or measurements of such dimensions relate to other parameters, e.g., with respect to movement, support, engagements, interfacing dimensions are provided to aid the reader's understanding of the features and may not be illustrated to scale nor universally applicable to every embodiment.

What is claimed is:

1. An underwater light probe, the light probe comprising:

a body comprising an electrical and mechanical interface concentric to the body and residing within a first bore of the body;

a heat sink forming at least a portion of the body and comprising a longitudinally extending mounting base comprising a plurality of laterally facing mounting surfaces configured to mount a plurality of laterally facing light elements thereon;

a lens assembly configured to couple to the body, wherein the lens assembly defines a second bore and a lip structure attached to the end of the second bore that continuously decreases in diameter toward the end of the second bore, wherein the lip structure defines an opening of the lens assembly, wherein the second bore is configured to receive the longitudinally extending mounting base and the plurality of laterally facing light elements mounted thereon, wherein an internal thread of the lens assembly is configured to couple to an external thread of the body so as to provide a watertight seal therearound when the lens assembly is coupled to the body.

2. The light probe of claim 1, wherein the lens assembly comprises a cylindrical shape defining the second bore, and wherein the lens assembly further comprises a lens portion extending along the second bore substantially perpendicular to the emission of light from the laterally facing light elements.

3. The light probe of claim 1, wherein the lens assembly is configured to be selectively coupled and uncoupled to the body.

4. The light probe of claim 3, wherein the heat sink further comprises a heat exchange feature configured to receive heat conducted from the mounting base and transfer the heat to surrounding fluid, and wherein the heat exchange feature comprises a plurality of fins.

5. The light probe of claim 1, wherein the laterally facing light elements comprise LEDs or LED arrays.

6. The light probe of claim 1, wherein at least one of the LEDs or LED arrays is coupled to a reflector or lens.

7. The light probe of claim 1, wherein the laterally facing light elements comprise LED arrays configured with separately dimmable electronics controllable by a change in a supplied drive current.

8. The light probe of claim 1, wherein the mounting base further comprises a longitudinally facing mounting surface positioned at a distal end of the mounting base, and wherein the longitudinally facing mounting surface is configured to mount a longitudinally facing light element.

9. The light probe of claim 8, further comprising a reflector assembly configured to couple to the distal end of the mounting base to provide directional reflection of the longitudinally facing light element, wherein the laterally facing light elements are positioned for hemispherical projection through the lens assembly, and wherein the laterally facing light elements and the longitudinally facing light element are separately addressable.

10. A modular underwater light probe comprising:

a body comprising an interface configured to couple to an implement;

a heat sink that forms at least a portion of the body and comprising a longitudinally extending mounting base comprising a plurality of laterally facing mounting surfaces configured to mount a plurality of laterally facing light elements thereon; and a lens assembly configured to couple to the body, wherein the lens assembly defines a bore and a lip structure attached to the end of the bore that continuously decreases in diameter toward the end of the bore, wherein the lip structure defines an opening of the lens assembly, wherein the bore is configured to receive the longitudinally extending mounting base and the plurality of laterally facing light elements mounted thereon, wherein an internal thread of the lens assembly is configured to couple to an external thread of the body so as to provide a watertight seal therearound when the lens assembly is coupled to the body.

11. The modular underwater light probe of claim 10, wherein the lens assembly is configured to be selectively coupled and uncoupled to the body.

12. The modular underwater light probe of claim 10, wherein the heat sink further comprises a heat exchange feature configured to receive heat conducted from the mounting base and transfer the heat to surrounding fluid, and wherein the heat exchange feature comprises a plurality of fins.

13. The modular underwater light probe of claim 10, wherein the laterally facing light elements comprise LEDs or LED arrays, and wherein at least one of the LEDs or LED arrays is coupled to a reflector or lens.

14. The modular underwater light probe of claim 10, wherein the laterally facing light elements comprise LED arrays configured with separately dimmable electronics controllable by a change in a supplied drive current.

15. The modular underwater light probe of claim 10, wherein the mounting base further comprises a longitudinally facing mounting surface positioned at a distal end of the mounting base, and wherein the longitudinally facing mounting surface is configured to mount a longitudinally facing light element.

16. The modular underwater light probe of claim 10, further comprising a reflector assembly configured to couple to the distal end of the mounting base to provide directional reflection of light emitted by the longitudinally facing light element, wherein the laterally facing light elements are positioned for hemispherical projection through the lens assembly, and wherein the laterally facing light elements and the longitudinally facing light element are separately addressable.

17. A underwater lighting device system, the system comprising:

a light probe configured to be selectively coupled to one or more implements, wherein the light probe comprises, a body comprising an electrical and mechanical interface concentric to the body and residing within a first bore of the body, a heat sink forming at least a portion of the body and comprising a longitudinally extending mounting base comprising a plurality of laterally facing mounting surfaces configured to mount a plurality of light elements thereon, and a lens assembly configured to couple to the body, wherein the lens assembly defines a second bore configured to receive the longitudinally extending mounting base and the plurality of light elements mounted thereon and provide a watertight seal therearound when coupled to the body.

18. The system of claim 17, wherein the system further comprises a plurality of light element assemblies comprising different arrangements of light elements, and wherein the light probe is configured for selectable coupling of the light element assemblies at the mounting surfaces to produce different beampatterns.

19. The system of claim 17, wherein the one or more implements comprises a controller and a user interface, wherein the light probe is configured to electrically couple to a supply of power and a controller through a connector interface when the light probe is coupled with the one or more implements.

20. The system of claim 17, wherein the light probe further comprises a longitudinally facing mounting surface positioned at a distal end of the mounting base, wherein the longitudinally facing mounting surface is configured to mount a light element, and wherein light elements mounted at the laterally facing mounting surface and the longitudinally facing mounting surface are separately addressable.

* * * * *